US008696384B2

(12) United States Patent
Yokoyama et al.

(10) Patent No.: US 8,696,384 B2
(45) Date of Patent: Apr. 15, 2014

(54) CONNECTOR AND MATING CONNECTOR

(71) Applicants: Japan Aviation Electronics Ind., Ltd., Tokyo (JP); Jae Taiwan, Ltd., Taichung (TW)

(72) Inventors: Yohei Yokoyama, Tokyo (JP); Masafumi Kodera, Taichung (TW); Kouji Kawase, Taichung (TW); Chien Chih Chen, Taichung (TW); Jui Feng Tai, Taichung (TW)

(73) Assignees: Japan Aviation Electronics Industry, Limited, Tokyo (JP); Jae Taiwan, Ltd., Taichung (TW)

( * ) Notice: Subject to any disclaimer, the term of this patent is extended or adjusted under 35 U.S.C. 154(b) by 0 days.

(21) Appl. No.: 13/749,089

(22) Filed: Jan. 24, 2013

(65) Prior Publication Data

US 2013/0196547 A1 Aug. 1, 2013

(30) Foreign Application Priority Data

Jan. 26, 2012 (JP) ..... 2012-014148

(51) Int. Cl.
*H01R 13/648* (2006.01)

(52) U.S. Cl.
USPC ..... 439/607.4; 439/607.36

(58) Field of Classification Search
USPC ..... 439/607.35–607.4
See application file for complete search history.

(56) References Cited

U.S. PATENT DOCUMENTS 6,007,381 A 12/1999 Ando et al.
6,305,984 B1 10/2001 Katoh et al.
6,319,063 B1 * 11/2001 Huang ..... 439/607.36
6,398,587 B1 * 6/2002 Chen et al. ..... 439/607.35
6,884,116 B2 4/2005 Suzuki et al.
7,670,150 B2 * 3/2010 Hisamatsu et al. ..... 439/79
7,727,019 B2 * 6/2010 Droesbeke et al. ..... 439/607.35
8,025,532 B2 9/2011 Nagata et al.

FOREIGN PATENT DOCUMENTS

JP 51-37289 U 9/1976
JP 11-067365 A 3/1999
JP 2000-357550 A 12/2000
JP 2004-014350 A 1/2004
JP 2011-040224 A 2/2011

OTHER PUBLICATIONS

Japanese Office Action mailed Feb. 28, 2013 (and English translation thereof), which issued in counterpart Japanese Application No. 2012-014148.

* cited by examiner

*Primary Examiner* — Neil Abrams
*Assistant Examiner* — Travis Chambers
(74) *Attorney, Agent, or Firm* — Holtz, Holtz, Goodman & Chick, PC

(57) ABSTRACT

A connector is fixable to an object such as a printed circuit board. The connector comprises a shell having a body portion and two fixed portions for fixing the body portion to the object. The body portion has two side portions and an upper portion coupling the side portions with each other in a lateral direction. The side portions are connected to the respective fixed portions. The fixed portion has a base portion and a strengthener. The base portion is located outward of the side portion in the lateral direction. The strengthener extends inward in the lateral direction from the base portion beyond the side portion.

11 Claims, 9 Drawing Sheets

【図 14】

CONNECTOR AND MATING CONNECTOR

CROSS REFERENCE TO RELATED APPLICATIONS

Applicants claim priority under 35 U.S.C. §119 of Japanese Patent Application No. JP2012-014148 filed Jan. 26, 2012.

BACKGROUND OF THE INVENTION

This invention relates to a connector configured to be fixed to an object such as a printed circuit board, a Flexible Printed Circuit (FPC) or a Flexible Flat Cable (FFC).

For example, a connector configured to be fixed to a circuit board is disclosed in JP-A 2000-357550 (Patent Document 1) and JP-A 2004-14350 (Patent Document 2), contents of which are incorporated herein by reference.

The connector of Patent Document 1 has a shell which is formed by bending a metal plate. The shell has a bottom portion, a fold-back portion and a shell terminal. The fold-back portion is formed by folding back the metal plate at a front end of the bottom portion so that the fold-back portion extends in a plane in parallel to the circuit board. The shell terminal is configured to be inserted in and fixed to a hole of the circuit board. More specifically, the shell terminal is formed at an end of the fold-back portion so as to extend in a plane perpendicular to the circuit board.

The connector of Patent Document 2 has a shell which is formed by bending a metal plate similar to the connector of Patent Document 1. The shell has a mating portion configured to be mated with a mating connector, and a shell terminal. The shell terminal is formed by folding back the metal plate at a front end of the mating portion so that the shell terminal extends in a plane perpendicular to the circuit board.

The fold-back portion of the connector of Patent Document 1 extends in the plane in parallel to the circuit board. Accordingly, when such a force that detaches the connector from the circuit board is applied to the connector, the shell might be easily deformed and damaged.

The mating portion and the shell terminal of the connector of Patent Document 2 are coupled with each other at a boundary portion which extends in a direction perpendicular to the circuit board. As the connector has lower profile, a size of the boundary portion in the direction perpendicular to the circuit board becomes smaller. Accordingly, when a size of the connector is small, strength of the boundary portion might be insufficient.

SUMMARY OF THE INVENTION

It is therefore an object of the present invention to provide a connector having a structure which is preventable a shell of the connector from being deformed even when the connector receives such a force that detach the connector from an object such as a circuit board.

One aspect (first aspect) of the present invention provides a connector fixable to an object. The connector comprises a contact, a holding member and a shell. The holding member holds the contact. The shell is attached to the holding member. The shell has a body portion at least partially covering the holding member, and two fixed portions for fixing the body portion to the object. The body portion has two side portions and an upper portion. The upper portion has a plate-like shape which is in parallel to a predetermined plane. The upper portion is located at an upper side of the shell in an upper-to-lower direction perpendicular to the predetermined plane.

The upper portion couples the side portions with each other in a lateral direction in parallel to the predetermined plane. The side portion is connected to the fixed portion so that the shell is provided with a boundary portion located between the side portion and the fixed portion. The boundary portion extends in a direction crossing the predetermined plane. The fixed portion has a base portion and a strengthener. The base portion is located outward of the side portion in the lateral direction. The strengthener extends inward in the lateral direction from the base portion beyond the side portion.

Another aspect (second aspect) of the present invention provides the connector, wherein the side portion is formed with an opening. The opening pierces the side portion in the lateral direction. The strengthener extends inward in the lateral direction while passing through the opening.

Yet another aspect (third aspect) of the present invention provides a mating connector mateable with the connector according to the second aspect. The mating connector comprises an engaging channel into which the strengthener is inserted when the connector and the mating connector are mated with each other.

An appreciation of the objectives of the present invention and a more complete understanding of its structure may be had by studying the following description of the preferred embodiment and by referring to the accompanying drawings.

Figure 1:
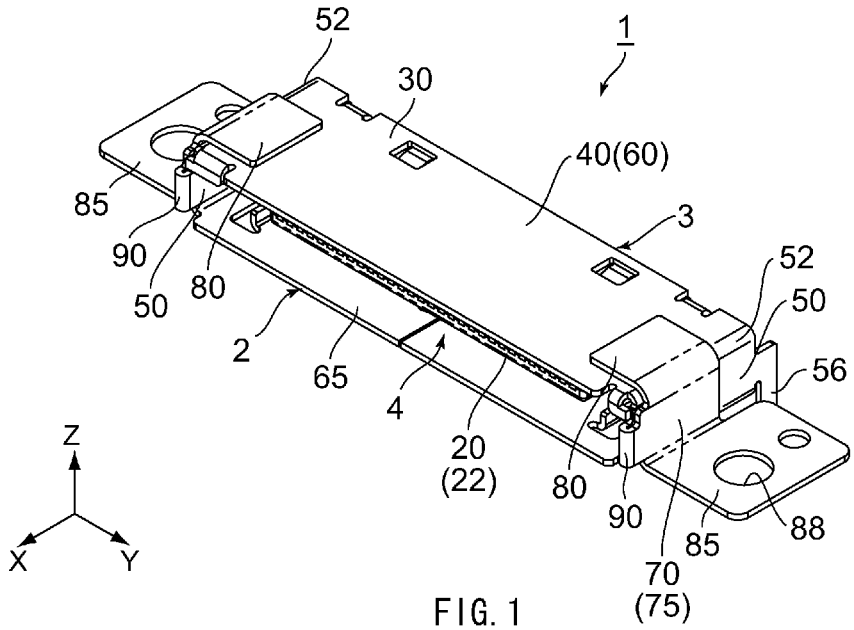
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

In the following embodiments, it is described about connectors configured to be mounted on and fixed to respective printed circuit boards (i.e. objects). In other words, the object according to the embodiment described below is a printed circuit board. However, the object according to the present invention may not be a printed circuit board. In other words, the connector according to the present invention is fixable to various circuit boards (i.e. objects) including a printed circuit board, an FPC and an FFC.

First Embodiment

Figure 2:
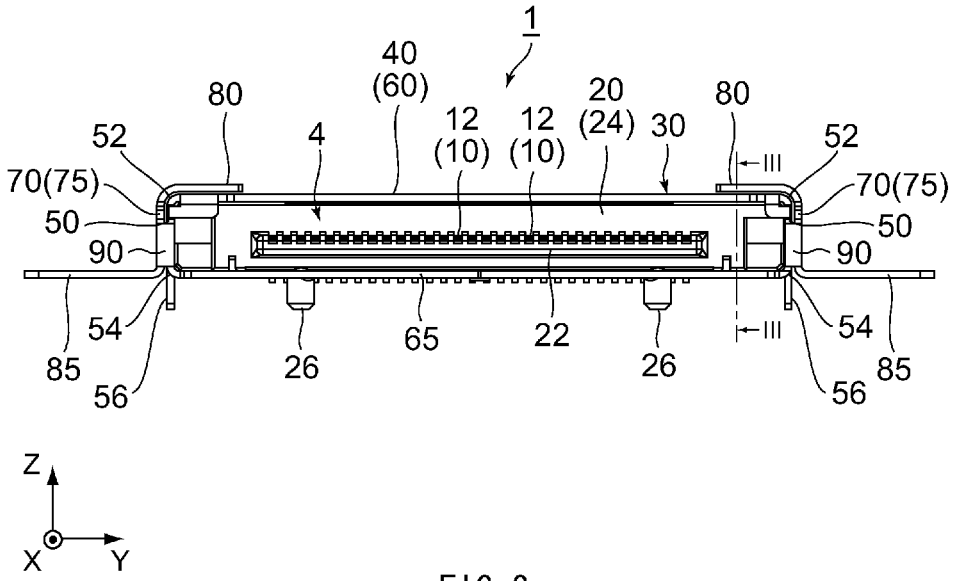
FIG. 2 is a front view showing the connector of FIG. 1.
Figure 3:
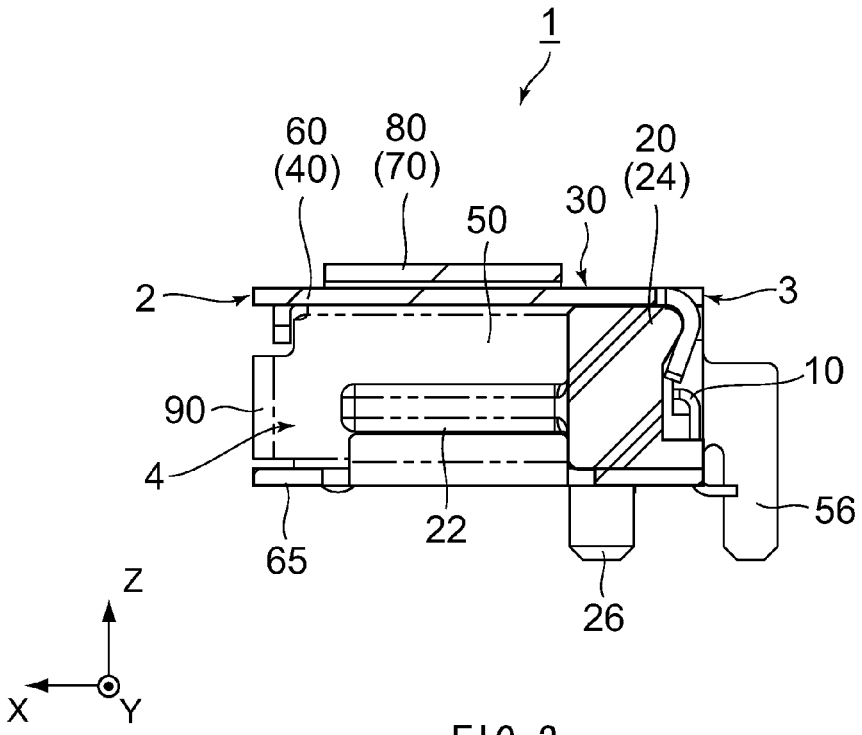
FIG. 3 is a cross-sectional view showing the connector of FIG. 2, taken along line III-III.

Referring to FIGS. 1 to 3, a connector 1 according to a first embodiment of the present invention comprises a plurality of contacts 10 each made of a conductive material, a holding member 20 made of an insulating material and a shell 30 made of a metal. The connector 1 has a front end (mating end) 2 and a rear end 3 in a front-to-rear direction (X-direction). As can be seen from FIGS. 1 to 5, the connector 1 according to the present embodiment is mateable with a mating connector 5. The front end (mating end) 2 of the connector 1 is configured to be mated with the mating connector 5.

As shown in FIG. 2, the contact 10 has a contact portion 12 which is brought into contact with a mating contact (not shown) of the mating connector 5 (see FIGS. 4 and 5) under a mated state where the connector 1 is mated with the mating connector 5. The holding member 20 holds the contacts 10. In detail, the contacts 10 are held by the holding member 20 so as to be arranged in a lateral direction (Y-direction). As shown in FIGS. 2 and 3, the holding member 20 has a plate portion 22, a rear-end portion 24 and two positioning bosses 26. The rear-end portion 24 is located in the vicinity of the rear end 3 (i.e. negative X-side end) of the connector 1. The plate portion 22 protrudes from the rear-end portion 24 toward the front end 2 of the connector 1 (i.e. protrudes along the positive X-direction) while the positioning bosses 26 project downward (i.e. in the negative Z-direction) from the rear-end portion 24. The contact portions 12 of the contacts 10 are arranged on an upper surface of the plate portion 22. The rear-end portion 24 has a block-like shape extending in the lateral direction (Y-direction). When the connector 1 is mounted on the circuit board (not shown), the positioning bosses 26 are inserted in respective positioning holes (not shown) provided in the circuit board (not shown) so that the connector 1 is positioned on the circuit board (not shown).

As can be seen from FIGS. 1 to 3, the shell 30 is formed by punching and bending a single metal plate. The shell 30 is attached to the holding member 20. In detail, the shell 30 has a body portion 40 at least partially covering the holding member 20, and two fixed portions 70 for fixing the body portion 40 to the circuit board (not shown).

The body portion 40 according to the present embodiment has a square tube-like shape extending short in the front-to-rear direction (X-direction). As seen from the front (i.e. from the positive X-side), the body portion 40 has a rectangular shape which is long in the lateral direction (Y-direction). The body portion 40 is thus configured so that the body portion 40 is formed with a receiving portion 4 for receiving the mating connector 5 (see FIGS. 4 and 5) along the front-to-rear direction (X-direction). The plate portion 22 of the holding member 20 is located within the receiving portion 4.

In detail, the body portion 40 has two side portions 50, an upper portion 60 and a bottom portion 65. The side portion 50 extends roughly in a plane (i.e. in the XZ-plane) perpendicular to the lateral direction (Y-direction) except a curve of a bending portion which is formed when the metal plate is bent. In other words, the side portion 50 has a plate-like shape extending in an upper-to-lower direction (Z-direction). Each of the side portions 50 has an upper edge 52 and a lower edge 54 in the upper-to-lower direction (Z-direction). Each of the upper portion 60 and the bottom portion 65 has a plate-like shape extending in parallel to a predetermined plane (i.e. the XY-plane which is a horizontal plane perpendicular to the upper-to-lower direction). The upper portion 60 is located at an upper side of the shell 30 in the upper-to-lower direction (Z-direction) while the bottom portion 65 is located at a lower side of the shell 30 in the upper-to-lower direction (Z-direction). The upper portion 60 couples the upper edges 52 of the two side portions 50 with each other in the lateral direction (Y-direction) which is in parallel to the predetermined plane. Similarly, the bottom portion 65 couples the lower edges 54 of the two side portions 50 with each other in the lateral direction (Y-direction). Each of the side portions 50 is formed with a post 56 at a rear end thereof. Accordingly, the body portion 40 has the two posts 56. The posts 56 extend downward (i.e. in the negative Z-direction). The posts 56 are inserted in and fixed (for example, soldered) to respective through holes (not shown) of the circuit board (not shown) when the connector 1 is mounted on the circuit board (not shown). The bottom portion 65 according to the present embodiment is comprised of two parts. The two parts of the bottom portion 65 are swaged so as to be connected to each other in the vicinity of the middle in the lateral direction (Y-direction).

The fixed portion 70 has a base portion 75, a strengthener 80 and a flange 85. The base portion 75 is located outward of the side portion 50 in the lateral direction (Y-direction). The strengthener 80 extends inward in the lateral direction (Y-direction) from the base portion 75 beyond the side portion 50. The flange 85 extends outward in the lateral direction (Y-direction) from the base portion 75.

The base portion 75 extends in parallel to the side portion 50. In other words, the base portion 75 extends in a plane (i.e. in the XZ-plane) perpendicular to the lateral direction (Y-direction). The side portion 50 is connected to the base portion 75 (i.e. the fixed portion 70) at the front end 2 of the connector 1 so that the shell 30 is provided with a boundary portion 90 located between the side portion 50 and the fixed portion 70. The boundary portion 90 is located in the vicinity of the front end 2 of the connector 1 (i.e. located at a side where the mating end 2 is provided). The boundary portion 90 according to the present embodiment extends in the upper-to-lower direction (Z-direction). In other words, the boundary portion 90 extends in a direction perpendicular to the predetermined plane (XY-plane). The boundary portion 90 may extend in a direction crossing the upper-to-lower direction (Z-direction). However, if the boundary portion 90 extends in parallel to the predetermined plane (XY-plane), the shell 30 might be easily deformed when the connector 1 receives an upward force (i.e. a force along the positive Z-direction). Accordingly, it is preferred that the boundary portion 90 extend in a direction crossing the predetermined plane (XY-plane) in order to ensure the strength of the shell 30.

The strengthener 80 extends from an upper end of the base portion 75 along the lateral direction (Y-direction). The strengthener 80 extends inward of the connector 1 beyond the side portion 50. Accordingly, as seen from above along the upper-to-lower direction (Z-direction), the strengthener 80 intersects with the side portion 50. The strengthener 80 according to the present embodiment extends to (i.e. is located on) an upper side (i.e. the positive Z-side) of the upper portion 60 so as to at least partially overlap the upper portion 60. Moreover, the strengthener 80 according to the present embodiment extends in the lateral direction (Y-direction) so as to be partially located over the receiving portion 4. Accordingly, the strengthener 80 is partially located over the mating connector 5 under the mated state of the connector 1 with the mating connector 5. The strengthener 80 according to the present embodiment has a constant size in the front-to-rear direction (X-direction) so that the strengthener 80 has a rectangular shape. However, the strengthener 80 may have a shape other than the rectangular shape. For example, the strengthener 80 may have an L-like shape. Moreover, the strengthener 80 may extend rearward of the base portion 75. For example, the strengthener 80 may extend to the rear-end portion 24 of the holding member 20. In this case, the strengthener 80 may be bent so as to cover a rear side of the rear-end portion 24 of the holding member 20.

Each of the flanges 85 is provided with a hole 88. The holes 88 are used when the connector 1 is screwed on the circuit board (not shown). In other words, the flanges 85 are able to be screwed to the circuit board (not shown). However, the flanges 85 may be fixed by soldering.

Figure 4:
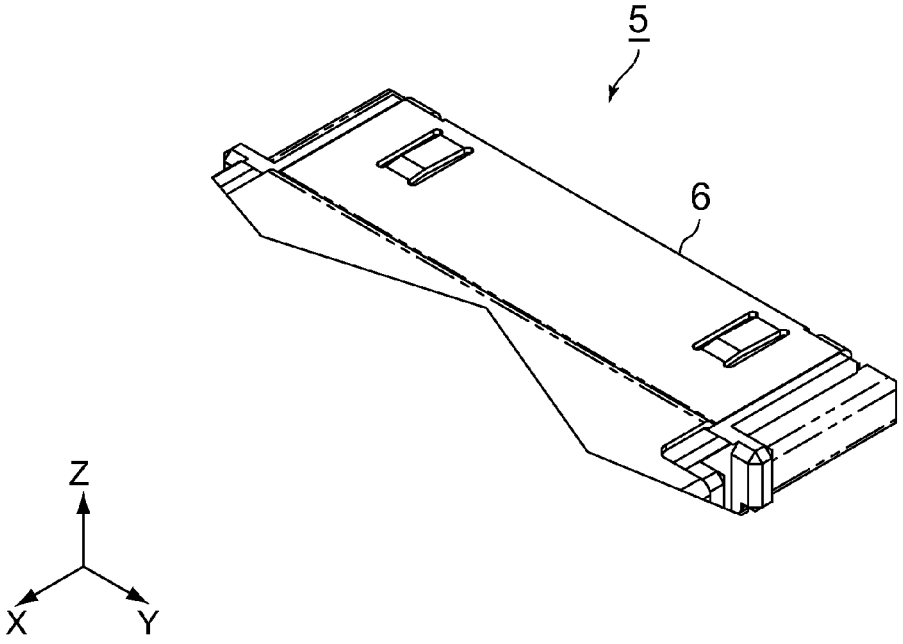
FIG. 4 is a perspective view showing a mating connector of the connector of FIG. 1.
Figure 5:
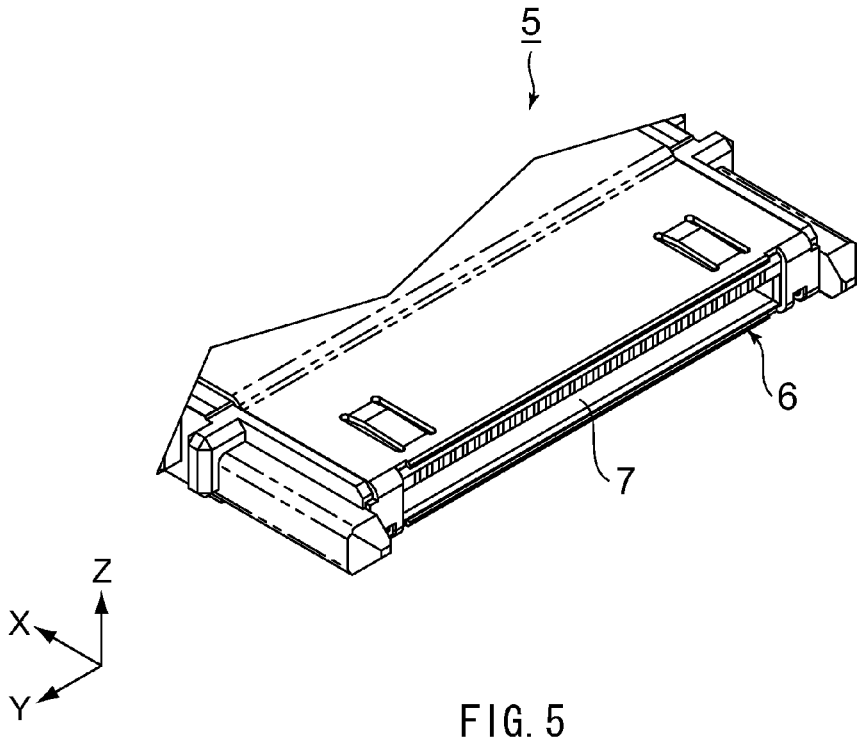
FIG. 5 is another perspective view showing the mating connector of FIG. 4.

Referring to FIGS. 4 and 5, the mating connector 5 according to the present embodiment comprises a mating portion 6. The mating portion 6 is provided with a receiver 7. Under the mated state of the connector 1 with the mating connector 5, the mating portion 6 is received in and mated with the receiving portion 4 of the connector 1 while the receiver 7 receives the plate portion 22 of the connector 1.

For example, the mating connector 5 is a cable connector connected to a cable. In this case, when the cable is swayed, such a force that detaches the connector 1 from the circuit board (not shown) may be applied to the connector 1 from the mating connector 5. According to the present embodiment, the boundary portion 90 is perpendicular to the predetermined plane (XY-plane) so that the side portion 50 is not easily away from the fixed portion 70 even when the aforementioned force is applied. Moreover, even if the aforementioned force is large, the strengthener 80 is brought into contact with the upper portion 60 so that the force is distributed on the strengthener 80. Accordingly, it is possible to prevent the boundary portion 90 from being damaged by receiving a stress concentration.

Second Embodiment

Figure 6:
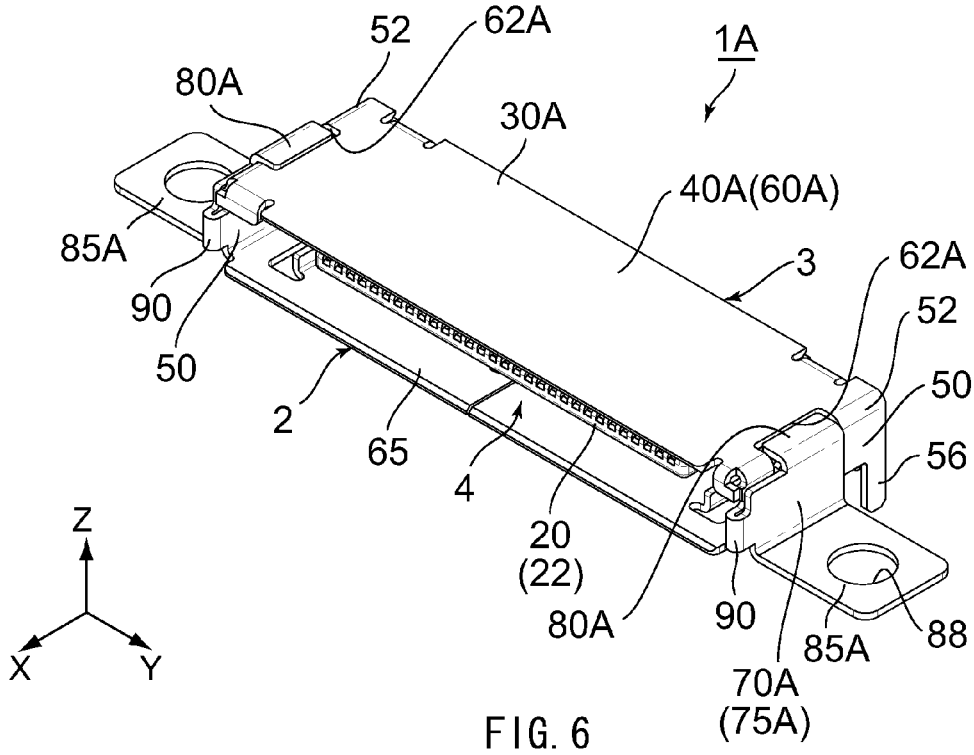
FIG. 6 is a perspective view showing a connector according to a second embodiment of the present invention.
Figure 7:
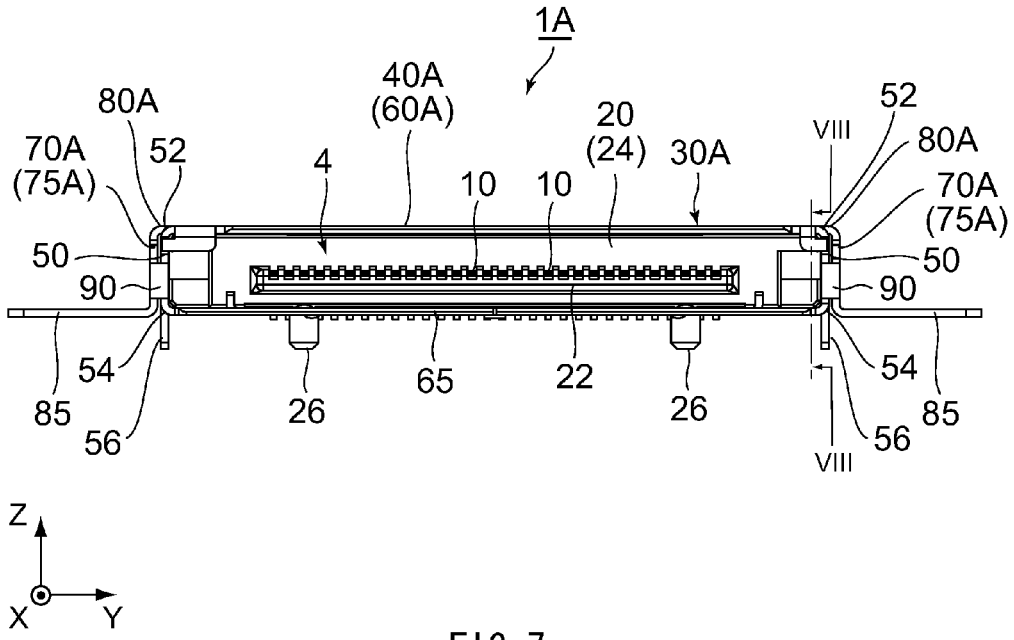
FIG. 7 is a front view showing the connector of FIG. 6.
Figure 8:
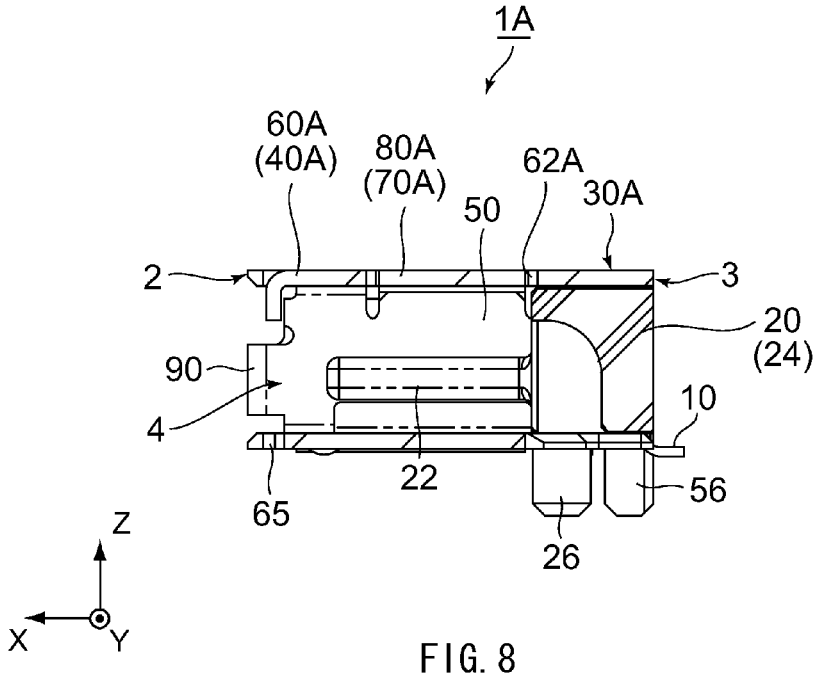
FIG. 8 is a cross-sectional view showing the connector of FIG. 7, taken along line VIII-VIII.

Referring to FIGS. 6 to 8, a connector 1A according to a second embodiment of the present invention is a modification of the connector 1 (see FIGS. 1 to 3) according to the aforementioned first embodiment. Similar to the connector 1, the connector 1A is mateable with and connectable to the aforementioned mating connector 5 (see FIGS. 4 and 5). The connector 1A according to the present embodiment comprises a plurality of the contacts 10 each made of the conductive material, the holding member 20 made of the insulating material and a shell 30A made of a metal. The holding member 20 holds the contacts 10. The shell 30A of the connector 1A according to the present embodiment is different from the shell 30 of the connector 1 (see FIGS. 1 to 3) according to the first embodiment while the other members of the connector 1A are configured similar to the connector 1. Accordingly, it is mainly described about differences between the shell 30A and the shell 30 in the following description.

As can be seen from FIGS. 6 to 8, the shell 30A is formed by punching and bending a single metal plate. The shell 30A is attached to the holding member 20. In detail, the shell 30A has a body portion 40A at least partially covering the holding member 20, and two fixed portions 70A for fixing the body portion 40A to the circuit board (not shown).

The body portion 40A according to the present embodiment has a square tube-like shape extending short in the front-to-rear direction (X-direction). As seen from the front (i.e. from the positive X-side), the body portion 40A has a rectangular shape which is long in the lateral direction (Y-direction). The body portion 40A is thus configured so that the body portion 40A is formed with the receiving portion 4 for receiving the mating connector 5 (see FIGS. 4 and 5) along the front-to-rear direction (X-direction).

In detail, the body portion 40A has the two plate-like side portions 50, a plate-like upper portion 60A and the plate-like bottom portion 65. The side portion 50 extends roughly in a plane (i.e. in the XZ-plane) perpendicular to the lateral direction (Y-direction) except the curve of the bending portion which is formed when the metal plate is bent. Each of the upper portion 60A and the bottom portion 65 extends in parallel to the predetermined plane (i.e. the XY-plane which is a horizontal plane). The upper portion 60A is located at an upper side of the shell 30A in the upper-to-lower direction (Z-direction) while the bottom portion 65 is located at a lower side of the shell 30A in the upper-to-lower direction (Z-direction). The upper portion 60A couples the upper edges 52 of the two side portions 50 with each other in the lateral direction (Y-direction). Similarly, the bottom portion 65 couples the lower edges 54 of the two side portions 50 with each other in the lateral direction (Y-direction). Each of the side portions 50 is formed with the post 56 at the rear end thereof. Accordingly, the body portion 40A has the two posts 56. The posts 56 extend downward (i.e. in the negative Z-direction). The bottom portion 65 according to the present embodiment is comprised of the two parts. The two parts of the bottom portion 65 are swaged so as to be connected to each other in the vicinity of the middle in the lateral direction (Y-direction).

The upper portion 60A according to the present embodiment is formed with a notch 62A. The notch 62A is recessed inward in the lateral direction (Y-direction) from the upper edge 52 of the side portion 50 so as to be partially located over the receiving portion 4. The notch 62A is partially located over the mating connector 5 under the mated state of the connector 1A with the mating connector 5.

The fixed portion 70A has a base portion 75A, a strengthener 80A and a flange 85A. The base portion 75A is located outward of the side portion 50 in the lateral direction (Y-direction). The strengthener 80A extends inward in the lateral direction (Y-direction) from the base portion 75A beyond the side portion 50. The flange 85A extends outward in the lateral direction (Y-direction) from the base portion 75A.

Similar to the base portion 75 (see FIG. 1) according to the first embodiment, the base portion 75A according to the present embodiment extends in parallel to the side portion 50. The side portion 50 is connected to the base portion 75A (i.e. the fixed portion 70A) at the front end 2 of the connector 1A so that the shell 30A is provided with the boundary portion 90 located between the side portion 50 and the fixed portion 70A. The boundary portion 90 is located in the vicinity of the front end (mating end) 2 of the connector 1A. The boundary portion 90 according to the present embodiment extends in a direction perpendicular to the predetermined plane (XY-plane).

The strengthener 80A is located in the vicinity of the upper portion 60A in the upper-to-lower direction (Z-direction). The strengthener 80A extends inward in the lateral direction (Y-direction) from the base portion 75A. In detail, the strengthener 80A extends in the notch 62A from an upper end of the base portion 75A along the lateral direction (Y-direction) over the upper edge 52 of the side portion 50. The strengthener 80A according to the present embodiment extends in the lateral direction (Y-direction) so as to be partially located over the receiving portion 4. Accordingly, the strengthener 80A is partially located over the mating connector 5 under the mated state of the connector 1A with the mating connector 5. The strengthener 80A according to the present embodiment has a constant size in the front-to-rear direction (X-direction) so that the strengthener 80A has a rectangular shape. However, the strengthener 80A may have a shape other than the rectangular shape. For example, the strengthener 80A may have an L-like shape. Moreover, the strengthener 80A may extend rearward of the base portion 75. In this case, the strengthener 80A may be bent so as to cover the rear side of the rear-end portion 24 of the holding member 20.

Each of the flanges 85A is provided with the hole 88. The holes 88 are used when the connector 1A is screwed on the circuit board (not shown). However, the flanges 85A may be fixed by soldering. As can be seen from FIGS. 1 and 6, the flange 85A according to the present embodiment is smaller than the flange 85 according to the first embodiment.

Similar to the first embodiment, the boundary portion 90 according to the present embodiment is perpendicular to the predetermined plane (i.e. the XY-plane which is a horizontal plane). Accordingly, the side portion 50 is not easily away from the fixed portion 70A even if such a force that detaches the connector 1A from the circuit board (not shown) is applied to the connector 1A. Moreover, even if the aforementioned force is large, the strengthener 80A is brought into contact with the upper edge 52 of the side portion 50 and the mating connector 5 so that the force is distributed on the strengthener 80A. Accordingly, it is possible to prevent the boundary portion 90 from being damaged by receiving a stress concentration.

The strengthener 80A according to the present embodiment is located at the almost same position as the upper portion 60A of the body portion 40A of the shell 30A in the upper-to-lower direction (Z-direction). Accordingly, a size in the upper-to-lower direction (Z-direction) of the connector 1A according to the present embodiment is smaller than a size in the upper-to-lower direction (Z-direction) of the connector 1 (see FIG. 2) according to the first embodiment by the thickness of the single metal which constitutes the shell 30A. In other words, according to the present embodiment, it is possible to further reduce a height of the connector. However, as considering the strength of the shell, the connector 1 according to the first embodiment is more preferable.

Third Embodiment

Figure 9:
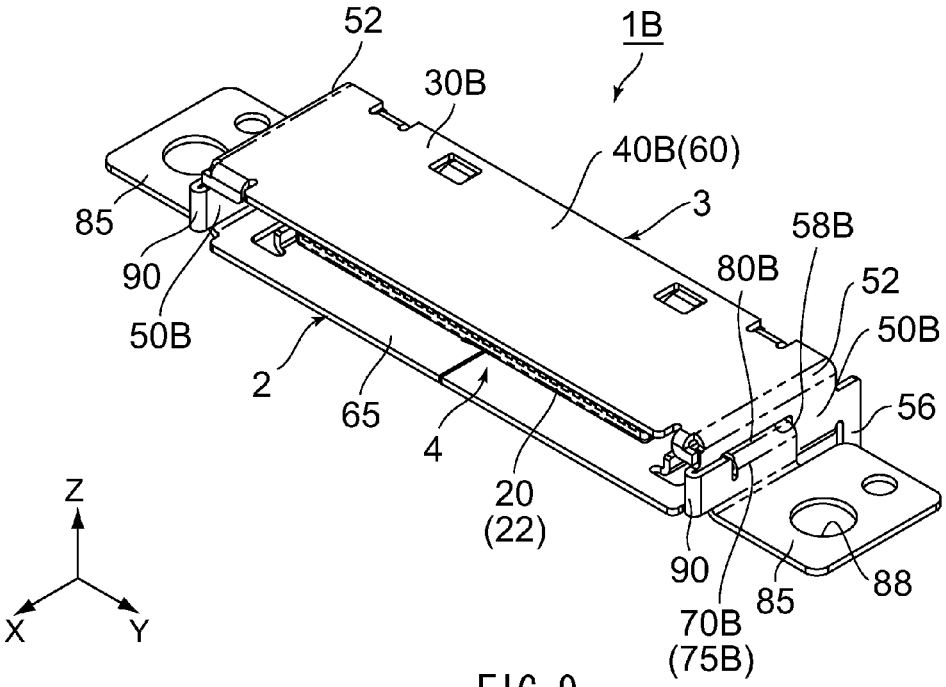
FIG. 9 is a perspective view showing a connector according to a third embodiment of the present invention.
Figure 10:
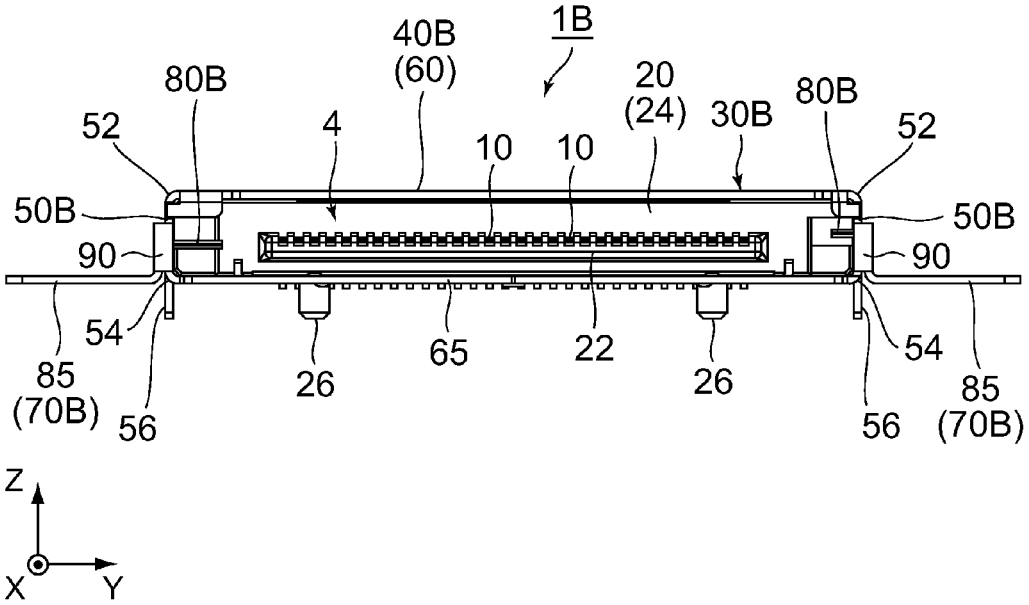
FIG. 10 is a front view showing the connector of FIG. 9.
Figure 11:
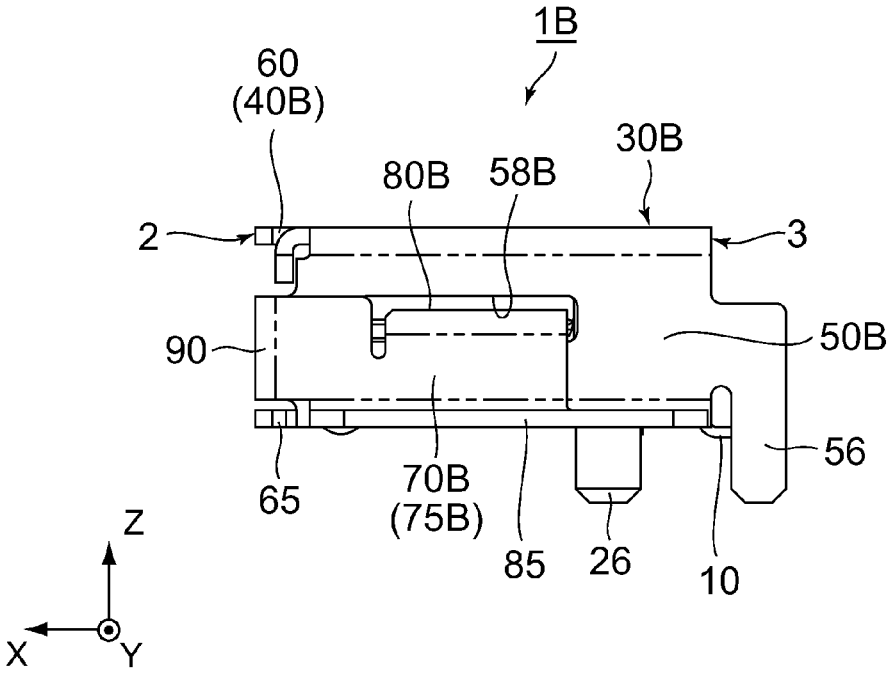
FIG. 11 is a side view showing the connector of FIG. 9.

Referring to FIGS. 9 to 11, a connector 1B according to a third embodiment of the present invention is a modification of the connector 1 (see FIGS. 1 to 3) according to the previously described first embodiment. The connector 1B is mateable with and connectable to a mating connector 5B (see FIGS. 12 and 13) different from the mating connector 5 (see FIGS. 4 and 5). The connector 1B according to the present embodiment comprises a plurality of the contacts 10 each made of the conductive material, the holding member 20 made of the insulating material and a shell 30B made of a metal. The holding member 20 holds the contacts 10. The shell 30B of the connector 1B according to the present embodiment is different from the shell 30 of the connector 1 (see FIGS. 1 to 3) according to the first embodiment while the other members of the connector 1B are configured similar to the connector 1. Accordingly, it is mainly described about differences between the shell 30B and the shell 30 in the following description.

Figure 12:
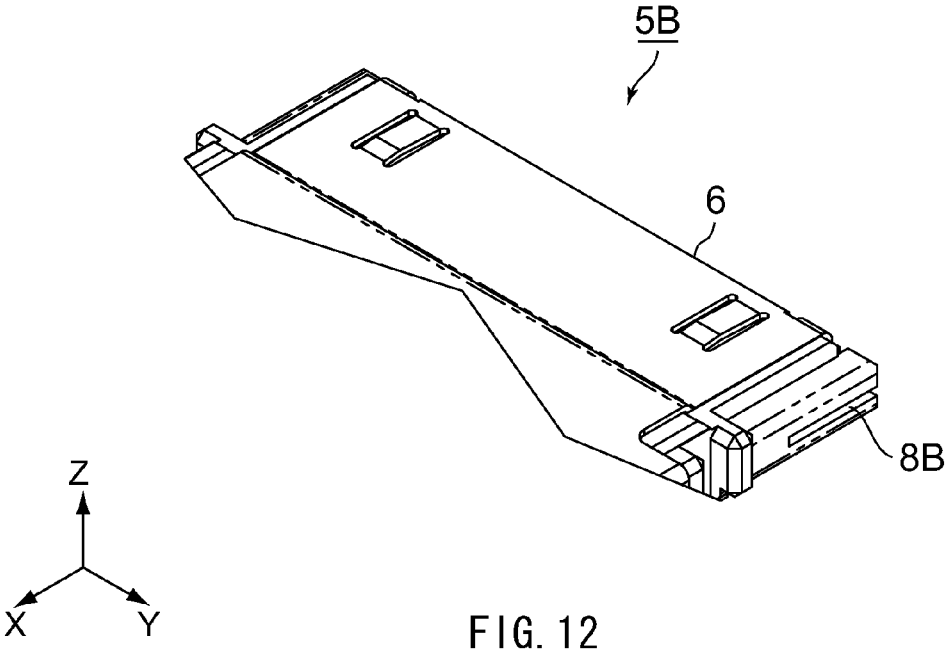
FIG. 12 is a perspective view showing a mating connector of the connector of FIG. 9.
Figure 13:
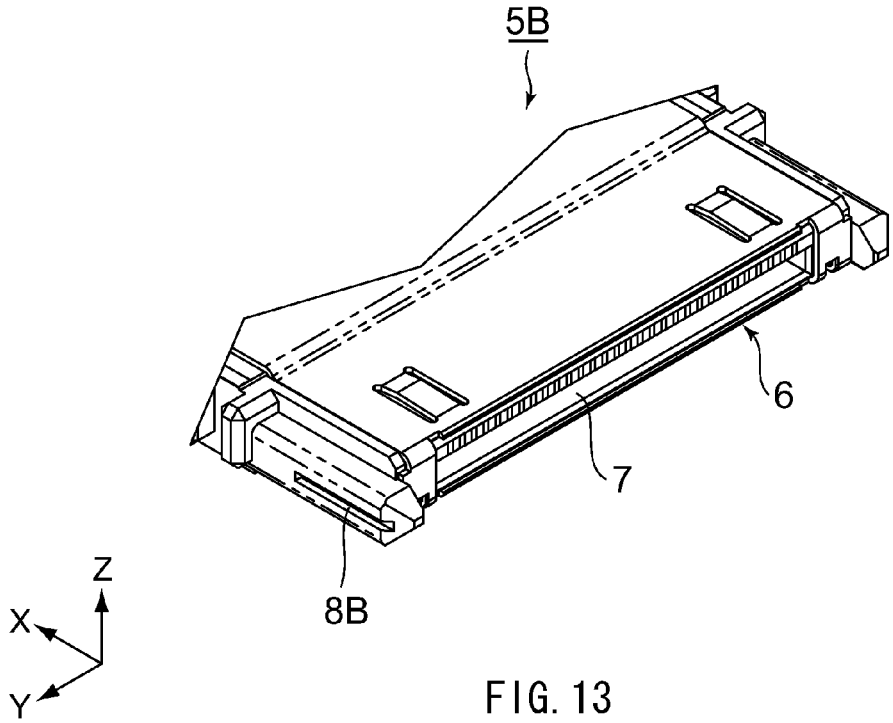
FIG. 13 is another perspective view showing the mating connector of FIG. 12.

Referring to FIGS. 12 and 13, the mating connector 5B according to the present embodiment is configured similar to the mating connector 5 according to the first embodiment in general. However, the mating connector 5B is configured slightly different from the mating connector 5. More specifically, the mating connector 5B is formed with two engaging channels 8B which are not provided in the mating connector 5. The engaging channels 8B are formed at opposite ends in the lateral direction (Y-direction) of the mating connector 5B, respectively, so as to extend along the front-to-rear direction (X-direction).

As can be seen from FIGS. 9 to 11, the shell 30B is formed by punching and bending a single metal plate. The shell 30B is attached to the holding member 20. In detail, the shell 30B has a body portion 40B at least partially covering the holding member 20, and two fixed portions 70B for fixing the body portion 40B to the circuit board (not shown).

The body portion 40B according to the present embodiment is configured similar to the body portion 40 (see FIG. 1). For example, the body portion 40B has a square tube-like shape. As seen from the front (i.e. from the positive X-side), the body portion 40B has a rectangular shape which is long in the lateral direction (Y-direction). The body portion 40B is thus configured so that the body portion 40B is formed with the receiving portion 4 for receiving the mating connector 5B (see FIGS. 12 and 13).

In detail, the body portion 40B has two plate-like side portions 50B, the plate-like upper portion 60 and the plate-like bottom portion 65. The side portion 50B extends roughly in a plane (i.e. in the XZ-plane) perpendicular to the lateral direction (Y-direction) except a curve of a bending portion which is formed when the metal plate is bent. Each of the upper portion 60 and the bottom portion 65 extends in parallel to the predetermined plane (i.e. the XY-plane which is a horizontal plane). The upper portion 60 couples the upper edges 52 of the two side portions 50B with each other in the lateral direction (Y-direction). Similarly, the bottom portion 65 couples the lower edges 54 of the two side portions 50B with each other in the lateral direction (Y-direction). Each of the side portions 50B is formed with the post 56 at a rear end thereof. Accordingly, the body portion 40B has the two posts 56. The posts 56 extend downward (i.e. in the negative Z-direction). The bottom portion 65 according to the present embodiment is comprised of the two parts. The two parts of the bottom portion 65 are swaged so as to be connected to each other in the vicinity of the middle in the lateral direction (Y-direction).

Referring to FIGS. 9 and 11, the side portion 50B according to the present embodiment is formed with an opening 58B. The opening 58B pierces the side portion 50B in the lateral direction (Y-direction). As can be seen from FIG. 11, the opening 58B has a rounded rectangular shape. The opening 58B is located forward of the rear-end portion 24 in the front-to-rear direction (X-direction). In other words, the opening 58B is located at the front end 2 side (i.e. the positive X-side) of the connector 1B.

The fixed portion 70B has a base portion 75B, a strengthener 80B and the flange 85. The base portion 75B is located outward of the side portion 50B in the lateral direction (Y-direction). The strengthener 80B extends inward in the lateral direction (Y-direction) from the base portion 75B beyond the side portion 50B. The flange 85 extends outward in the lateral direction (Y-direction) from the base portion 75B.

Similar to the base portion 75 (see FIG. 1) according to the first embodiment, the base portion 75B according to the present embodiment extends in parallel to the side portion 50B. The side portion 50B is connected to the base portion 75B (i.e. the fixed portion 70B) at the front end 2 of the connector 1B so that the shell 30B is provided with the boundary portion 90 located between the side portion 50B and the fixed portion 70B. The boundary portion 90 is located in the vicinity of the front end (mating end) 2 of the connector 1B. The boundary portion 90 according to the present embodiment extends in a direction perpendicular to the predetermined plane (XY-plane).

The strengthener 80B extends inward in the lateral direction (Y-direction) from the base portion 75B. In detail, the strengthener 80B extends in the receiving portion 4 from an upper end of the base portion 75B while passing through the opening 58B of the side portion 50B along the lateral direction (Y-direction). In other words, the strengthener 80B pierces the side portion 50B in the lateral direction (Y-direction). The strengthener 80B is at least partially inserted in the engaging channel 8B of the mating connector 5B under the mated state of the connector 1B with the mating connector 5B.

Each of the flanges 85 is provided with the hole 88. The holes 88 are used when the connector 1B is screwed on the circuit board (not shown). However, the flanges 85 may be fixed by soldering.

Similar to the first embodiment, the boundary portion 90 according to the present embodiment is perpendicular to the predetermined plane (i.e. the XY-plane which is a horizontal plane). Accordingly, the side portion 50B is not easily away from the fixed portion 70B even if such a force (i.e. an upward force) that detaches the connector 1B from the circuit board (not shown) is applied to the connector 1B. Moreover, the strengthener 80B according to the present embodiment is held by the engaging channel 8B of the mating connector 5B. Accordingly, even if the aforementioned force is large, the strengthener 80B is brought into contact with an inner wall of the engaging channel 8B and an edge of the opening 58B of the side portion 50B so that the force is distributed on the strengthener 80B. Accordingly, it is possible to prevent the boundary portion 90 from being damaged by receiving a stress concentration.

According to the present embodiment, a holding of the strengthener 80B by the engaging channel 8B regulates a movement of the strengthener 80B in the upper-to-lower direction (Z-direction). Accordingly, it is possible to prevent the shell 30B from being deformed not only when the upward force is applied to the connector 1B but also when a downward force is applied to the connector 1B.

Fourth Embodiment

Referring to FIGS. 14 to 17, a connector 1C according to a fourth embodiment of the present invention is a modification of the connector 1B (see FIGS. 9 to 11) according to the aforementioned third embodiment. Similar to the connector 1B, the connector 1C is mateable with and connectable to the aforementioned mating connector 5B (see FIGS. 12 and 13). The connector 1C according to the present embodiment comprises a plurality of the contacts 10 each made of the conductive material, a holding member 20C made of an insulating material and a shell 30C made of a metal. The holding member 20C holds the contacts 10. The holding member 20C and the shell 30C of the connector 1C according to the present embodiment are different from the holding member 20 and the shell 30B of the connector 1B (see FIGS. 9 to 11) according to the third embodiment, respectively. Accordingly, it is mainly described about differences between the connector 1C and the connector 1B in the following description.

Figure 16:
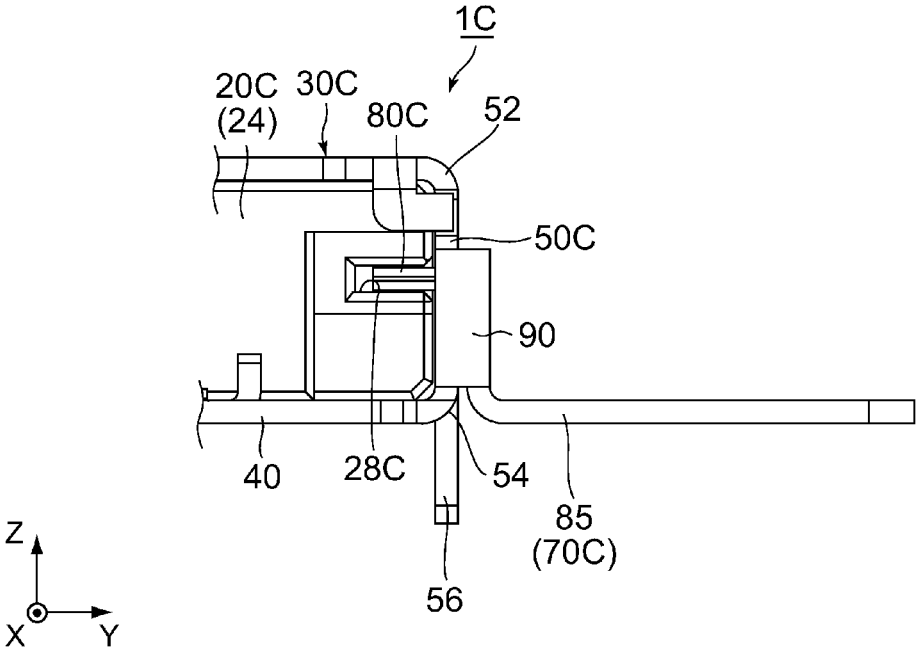
FIG. 16 is a partially enlarged, front view showing a part of the connector of FIG. 15.

As shown in FIG. 16, the holding member 20C is formed with two ditches 28C. In detail, the rear-end portion 24 of the holding member 20C has a block-like shape extending in the lateral direction (Y-direction). The ditches 28C are provided at opposite ends of the rear-end portion 24 in the lateral direction (Y-direction), respectively. As can be seen from FIGS. 16 and 17, each of the ditches 28C is recessed inward in the lateral direction (Y-direction) while extending in the front-to-rear direction (X-direction).

As can be seen from FIGS. 14 to 17, the shell 30C is formed by punching and bending a single metal plate. The shell 30C is attached to the holding member 20C. In detail, the shell 30C has a body portion 40C at least partially covering the holding member 20C, and two fixed portions 70C for fixing the body portion 40C to the circuit board (not shown).

Similar to the third embodiment, the body portion 40C according to the present embodiment has a square tube-like shape. As seen from the front (i.e. from the positive X-side), the body portion 40C has a rectangular shape which is long in the lateral direction (Y-direction). The body portion 40C is thus configured so that the body portion 40C is formed with the receiving portion 4 for receiving the mating connector 5B (see FIGS. 12 and 13).

In detail, the body portion 40C has two plate-like side portions 50C, the plate-like upper portion 60 and the plate-like bottom portion 65. The side portion 50C extends roughly in a plane (i.e. in the XZ-plane) perpendicular to the lateral direction (Y-direction) except a curve of a bending portion which is formed when the metal plate is bent. Each of the upper portion 60 and the bottom portion 65 extends in parallel to the predetermined plane (i.e. the XY-plane which is a horizontal plane). The upper portion 60 couples the upper edges 52 of the two side portions 50C with each other in the lateral direction (Y-direction). Similarly, the bottom portion 65 couples the lower edges 54 of the two side portions 50C with each other in the lateral direction (Y-direction). Each of the side portions 50C is formed with the post 56 at a rear end thereof. Accordingly, the body portion 40C has the two posts 56. The posts 56 extend downward (i.e. in the negative Z-direction). The bottom portion 65 according to the present embodiment is comprised of the two parts. The two parts of the bottom portion 65 are swaged so as to be connected to each other in the vicinity of the middle in the lateral direction (Y-direction).

Figure 14:
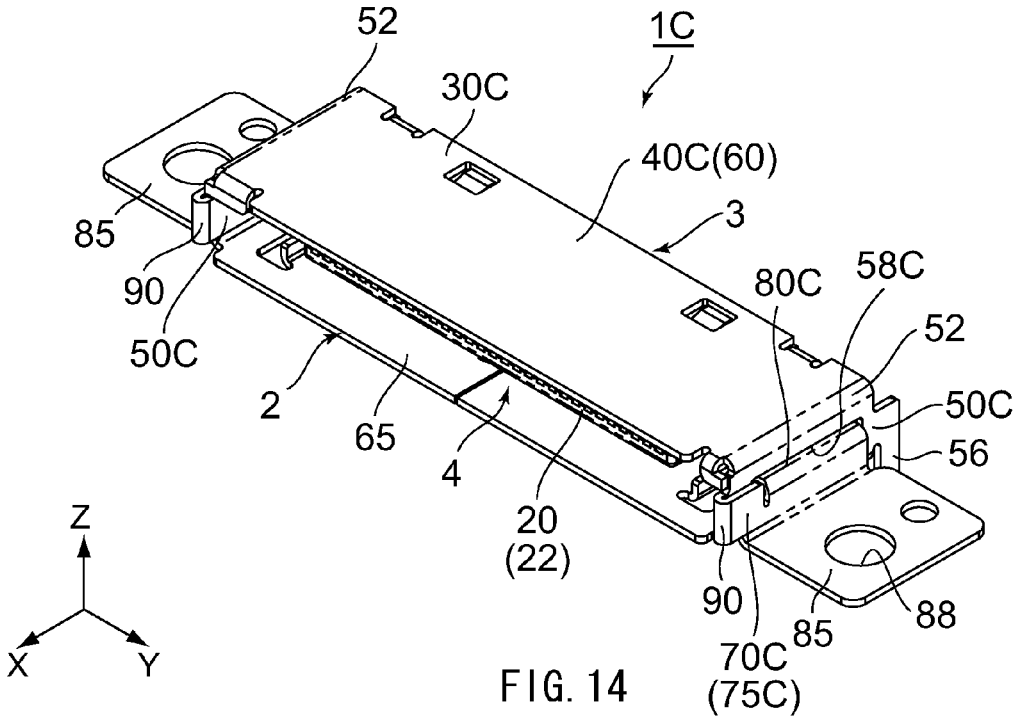
FIG. 14 is a perspective view showing a connector according to a fourth embodiment of the present invention.
Figure 15:
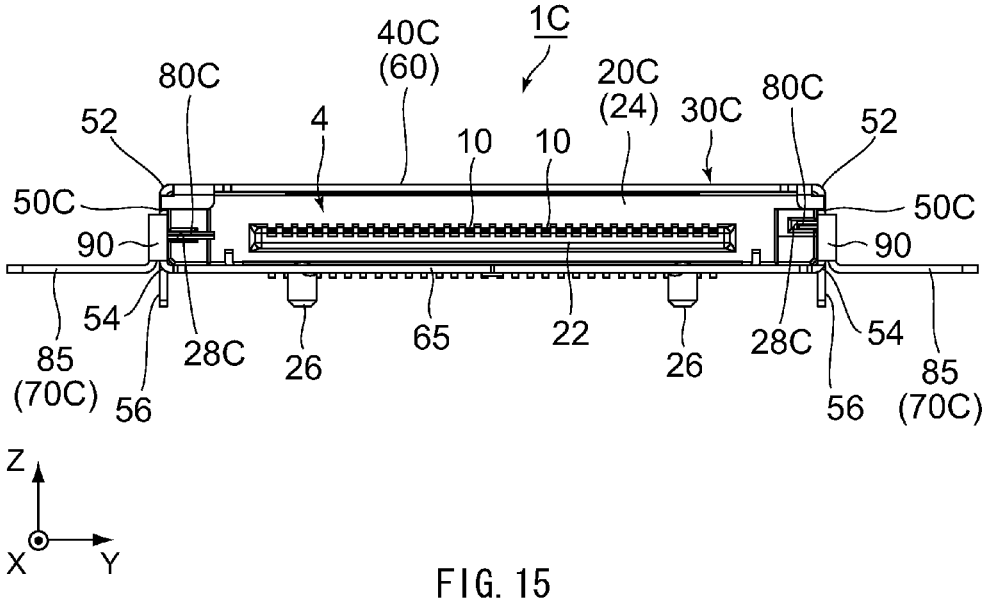
FIG. 15 is a front view showing the connector of FIG. 14.
Figure 17:
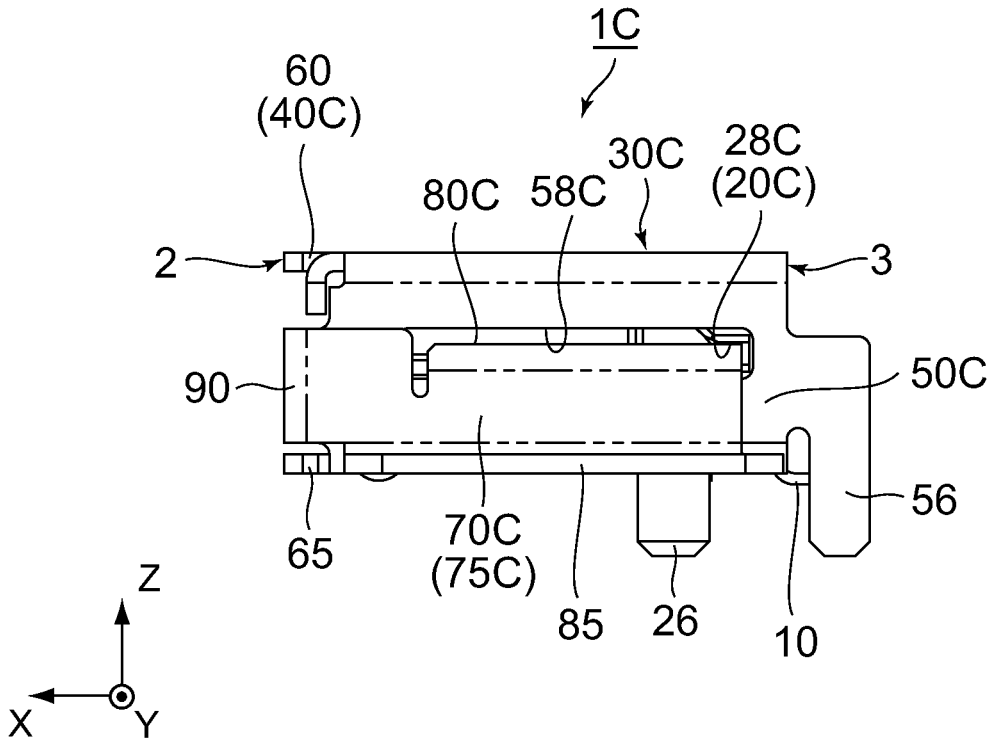
FIG. 17 is a side view showing the connector of FIG. 14.

Referring to FIGS. 14 and 17, the side portion 50C according to the present embodiment is formed with an opening 58C. The opening 58C pierces the side portion 50C in the lateral direction (Y-direction). As can be seen from FIG. 17, the opening 58C has a rounded rectangular shape. The opening 58C according to the present embodiment is formed differently from the opening 58B (see FIG. 11) according to the third embodiment. More specifically, the opening 58C is longer than the opening 58B (see FIG. 11) in the front-to-rear direction (X-direction). Moreover, a rear side of the opening 58C (i.e. a part of the opening 58C which is nearer to the rear end 3 of the connector 1C) is located at the same position as the rear-end portion 24 (see FIG. 3) in the front-to-rear direction (X-direction). Accordingly, the ditch 28C is located inward from the rear side of the opening 58C in the lateral direction (Y-direction).

The fixed portion 70C has a base portion 75C, a strengthener 80C and the flange 85. The base portion 75C is located outward of the side portion 50C in the lateral direction (Y-direction). The strengthener 80C extends inward in the lateral direction (Y-direction) from the base portion 75C beyond the side portion 50C. The flange 85 extends outward in the lateral direction (Y-direction) from the base portion 75C.

Similar to the base portion 75B (see FIG. 9) according to the third embodiment, the base portion 75C according to the present embodiment extends in parallel to the side portion 50C. The side portion 50C is connected to the base portion 75C (i.e. the fixed portion 70C) at the front end 2 of the connector 1C so that the shell 30C is provided with the boundary portion 90 located between the side portion 50C and the fixed portion 70C. The boundary portion 90 is located in the vicinity of the front end (mating end) 2 of the connector 1C. The boundary portion 90 according to the present embodiment extends in a direction perpendicular to the predetermined plane (XY-plane).

The strengthener 80C extends inward in the lateral direction (Y-direction) from the base portion 75C. In detail, the strengthener 80C extends in the receiving portion 4 from an upper end of the base portion 75C while passing through the opening 58C of the side portion 50C along the lateral direction (Y-direction). In other words, the strengthener 80C pierces the side portion 50C in the lateral direction (Y-direction). The strengthener 80C is at least partially inserted in the ditch 28C of the holding member 20C. Moreover, the strengthener 80C is at least partially inserted in the engaging channel 8B of the mating connector 5B under the mated state of the connector 1C with the mating connector 5B.

Each of the flanges is provided with the hole 88. The holes 88 are used when the connector 1C is screwed on the circuit board (not shown). However, the flanges 85 may be fixed by soldering.

Similar to the third embodiment, the boundary portion 90 according to the present embodiment is perpendicular to the predetermined plane (i.e. the XY-plane which is a horizontal plane). Accordingly, the side portion 50C is not easily away from the fixed portion 70C even if such a force (i.e. an upward force) that detaches the connector 1C from the circuit board (not shown) is applied to the connector 1C. Moreover, the strengthener 80C according to the present embodiment is held by the ditch 28C of the holding member 20C and the engaging channel 8B of the mating connector 5B. Accordingly, even if the aforementioned force is large, the strengthener 80C is brought into contact with an inner wall of the ditch 28C, the inner wall of the engaging channel 8B and an edge of the opening 58C of the side portion 50C so that the force is distributed on the strengthener 80C. Accordingly, it is possible to prevent the boundary portion 90 from being damaged by receiving a stress concentration.

According to the present embodiment, the holding of the strengthener 80C by both the ditch 28C and the engaging channel 8B regulates a movement of the strengthener 80C in the upper-to-lower direction (Z-direction). Accordingly, it is possible to prevent the shell 30C from being deformed not only when the upward force is applied to the connector 1C but also when a downward force is applied to the connector 1C.

According to the aforementioned embodiments, the base portion of the fixed portion is connected to the side portion at the front end side (a side configured to be mated with the mating connector) of the connector. However, the base portion and the fixed portion may be connected at a position different from the front end of the connector. For example, the base portion may be formed by bending the metal plate forward at a rear side position (for example, a position where the post is formed). In this case, the base portion is connected to the side portion at a rear end side of the connector. However, as considering the strength against the swaying of the mating connector, it is preferred to connect the base portion to the side portion at the front end side of the connector.

Each of the connectors according to the aforementioned embodiments comprises the only two fixed portions. However, the connector may comprise three or more fixed portions. For example, it is possible to form the two fixed portions at each of the opposite ends in the lateral direction of the connector. In detail, the base portion of one of the two fixed portions may be connected to the front end side of the connector while the base portion of another one of the two fixed portions may be connected to the rear end side of the connector. In this case, the connector comprises the four fixed portions in all.

The present application is based on a Japanese patent application of JP2012-014148 filed before the Japan Patent Office on Jan. 26, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector fixable to an object, the connector comprising:

a contact;

a holding member holding the contact; and a shell attached to the holding member, the shell having a body portion at least partially covering the holding member, and two fixed portions for fixing the body portion to the object, the body portion having two side portions and an upper portion, the upper portion having a plate-like shape which is in parallel to a predetermined plane, the upper portion being located at an upper side of the shell in an upper-to-lower direction perpendicular to the predetermined plane, the upper portion coupling the side portions with each other in a lateral direction in parallel to the predetermined plane, the side portion being connected to the fixed portion so that the shell is provided with a boundary portion located between the side portion and the fixed portion, the boundary portion extending in a direction crossing the predetermined plane, the fixed portion having a base portion and a strengthener, the base portion being located outward of the side portion in the lateral direction, the strengthener extending inward along the lateral direction from the base portion beyond the side portion.

2. The connector as recited in claim 1, wherein:

as seen from above, the strengthener intersects with the side portion.

3. The connector as recited in claim 1, wherein:

the strengthener extends to an upper side of the upper portion so as to at least partially overlap the upper portion.

4. The connector as recited in claim 1, wherein:

the upper portion is formed with a notch, the notch being recessed inward in the lateral direction from an upper edge of the side portion; and the strengthener is located in the vicinity of the upper portion in the upper-to-lower direction, the strengthener extending in the notch over the upper edge of the side portion.

5. The connector as recited in claim 1, the connector comprising:

a mating end configured to be mated with a mating connector, wherein:

the boundary portion is located at a side where the mating end is provided.

6. The connector as recited in claim 1, wherein:

the shell is formed by punching and bending a single metal plate.

7. The connector as recited in claim 1, wherein:

the object is a printed circuit board;

the fixed portion further has a flange, the flange extending outward in the lateral direction from the base portion; and the flange is able to be screwed to the printed circuit board.

8. The connector as recited in claim 1, wherein:

the side portion is formed with an opening, the opening piercing the side portion in the lateral direction; and the strengthener extends inward in the lateral direction while passing through the opening.

9. A mating connector mateable with the connector recited in claim 8, the mating connector comprising:

an engaging channel which the strengthener is inserted into when the connector and the mating connector are mated with each other.

10. The connector as recited in claim 8, wherein:

the holding member is formed with a ditch; and the strengthener is at least partially inserted in the ditch.

11. A mating connector mateable with the connector recited in claim 10, the mating connector comprising:

an engaging channel which the strengthener is inserted into when the connector and the mating connector are mated with each other.

* * * * *